US006568528B2

(12) United States Patent
Murray

(10) Patent No.: US 6,568,528 B2
(45) Date of Patent: May 27, 2003

(54) DISPLAY CONTAINER

(75) Inventor: John Murray, Brookline, NH (US)

(73) Assignee: Inland Paperboard and Packaging, Inc., Indianapolis, IN (US)

( * ) Notice: Subject to any disclaimer, the term of this patent is extended or adjusted under 35 U.S.C. 154(b) by 31 days.

(21) Appl. No.: 09/939,495

(22) Filed: Aug. 24, 2001

(65) Prior Publication Data

US 2002/0084201 A1 Jul. 4, 2002

Related U.S. Application Data

(60) Provisional application No. 60/258,688, filed on Dec. 29, 2000.

(51) Int. Cl.[7] ..... B65D 85/00
(52) U.S. Cl. ..... 206/315.9; 206/780
(58) Field of Search ..... 206/315.9, 315.91, 206/485, 779, 780; 221/121

(56) References Cited

U.S. PATENT DOCUMENTS

| | | | | |
|---|---|---|---|---|
| 3,231,993 A | | 2/1966 | Levy | |
| 3,439,917 A | | 4/1969 | Gentile | |
| 3,815,735 A | | 6/1974 | Cucuo | |
| 3,987,893 A | | 10/1976 | Hanson | |
| 4,315,569 A | * | 2/1982 | Jaeschke | 229/122 |
| 4,452,355 A | * | 6/1984 | Benham | 206/315.9 |
| 4,779,726 A | | 10/1988 | Pratt | |
| 4,795,031 A | | 1/1989 | Voss et al. | |
| 5,115,965 A | | 5/1992 | Alepuz | |
| 5,322,210 A | | 6/1994 | Chila et al. | |
| D357,181 S | | 4/1995 | Baker | |
| D386,533 S | | 11/1997 | Kvoka | |
| 5,695,056 A | | 12/1997 | Bender et al. | |
| 6,036,010 A | | 3/2000 | Seyffert et al. | |
| 6,199,692 B1 | * | 3/2001 | Van Ness et al. | 206/315.9 |

* cited by examiner

*Primary Examiner*—David T. Fidei
(74) *Attorney, Agent, or Firm*—Barnes & Thornburg

(57) ABSTRACT

A display container for displaying a spherical article includes a left side panel, a right side panel, and a connector coupled to the left side panel and the right side panel. Each of the left and right side panels includes a curved edge adapted to engage the spherical article. The curved edges cooperate to define a C-shaped opening to receive the spherical article therein. The connector is configured so that much of the surface area of the spherical article is exposed outside of the display container.

41 Claims, 5 Drawing Sheets

DISPLAY CONTAINER

This application claims priority under 35 U.S.C. §119(e) to U.S. Provisional Application Serial No. 60/258,688, filed Dec. 29, 2000, which is expressly incorporated by reference herein.

BACKGROUND AND SUMMARY OF THE INVENTION

The present invention relates to a container, and particularly to a container for displaying a spherical product. More particularly, the present invention relates to a display container made of corrugated paperboard material.

Display containers are configured to contain articles for viewing by a bystander. Some display containers are configured to display a spherical article, such as an inflatable ball.

According to the present disclosure, a display container for displaying a spherical article includes a left side panel, a right side panel, and a connector coupled to the left side panel and the right side panel. Each of the left and right side panels includes a curved edge adapted to engage the spherical article. The curved edges cooperate to provide means for defining a C-shaped opening to receive the spherical article therein. The C-shaped opening is designed for exposure of surface area of the spherical article so that a bystander can interact with the spherical article by sight and touch, for example, while the spherical article remains in the display container.

In illustrative embodiments, the connector includes a top panel, a bottom panel, a rear panel, an upper front panel, and a lower front panel. The top panel, the bottom panel, the upper front panel, and the lower front panel are coupled to the left and right side panels.

The upper and lower front panels include support surfaces adapted to engage the spherical article when the spherical article is positioned in the C-shaped opening. The support surfaces cooperate to trap the spherical article in place to prevent the spherical article from rotating in the display container. The upper and lower front panels also include support flaps that reinforce the support surfaces.

Each of the upper front panel and the lower front panel further includes left and right side flaps. The left and right side flaps of the upper front panel interlock with one another and the left and right side flaps of the lower front panel interlock with one another so that sections of the left and right side panels taper toward one another to expose surface area of the spherical article.

Each of the side panels includes one or more score lines. Illustratively, each side panel includes upper, lower, and rearward score lines that extend from the respective curved edge to the connector. The upper and lower score lines are designed to relieve stress in the display container that may be generated by interaction between the spherical article and the display container. The rearward score lines extend beyond the side panels into sections of the rear panel to allow the side panels and the sections of the rear panel to flare away from one another along the rearward score lines to facilitate insertion of the spherical article through the rear of the display container into the C-shaped opening.

Additional features of the present invention will become apparent to those skilled in the art upon consideration of the following detailed description of the invention.

BRIEF DESCRIPTION OF THE DRAWINGS

The detailed description particularly refers to the accompanying figures in which.

DETAILED DESCRIPTION OF THE DRAWINGS

Figure 1:
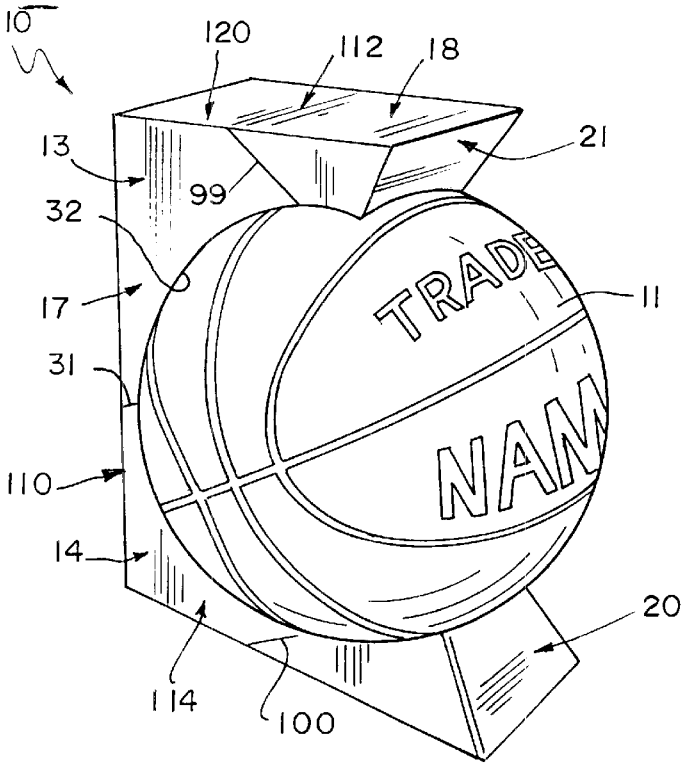
FIG. 1 is a perspective view of a display container showing the display container in a product-displaying position wherein the display container is formed to include a C-shaped opening sized to receive an inflatable ball, for example, for display of the inflatable ball in a way that exposes much of the surface area of the inflatable ball.

A display container 10 is configured to hold a spherical product such as, for example, an inflatable ball 11 in a product-displaying position for display of inflatable ball 11, as shown, for example, in FIG. 1. At the same time, container 10 is configured to support inflatable ball 11 on a support surface (not shown). Container 10 is configured to display inflatable ball 11 so as to expose much of the surface area of inflatable ball 11 for viewing by a bystander. Container 10 is formed to include a C-shaped opening 12 sized to receive inflatable ball 11 so that the bystander can see and feel the exposed surface area of inflatable ball 11 while inflatable ball 11 remains in container 10.

Figure 3:
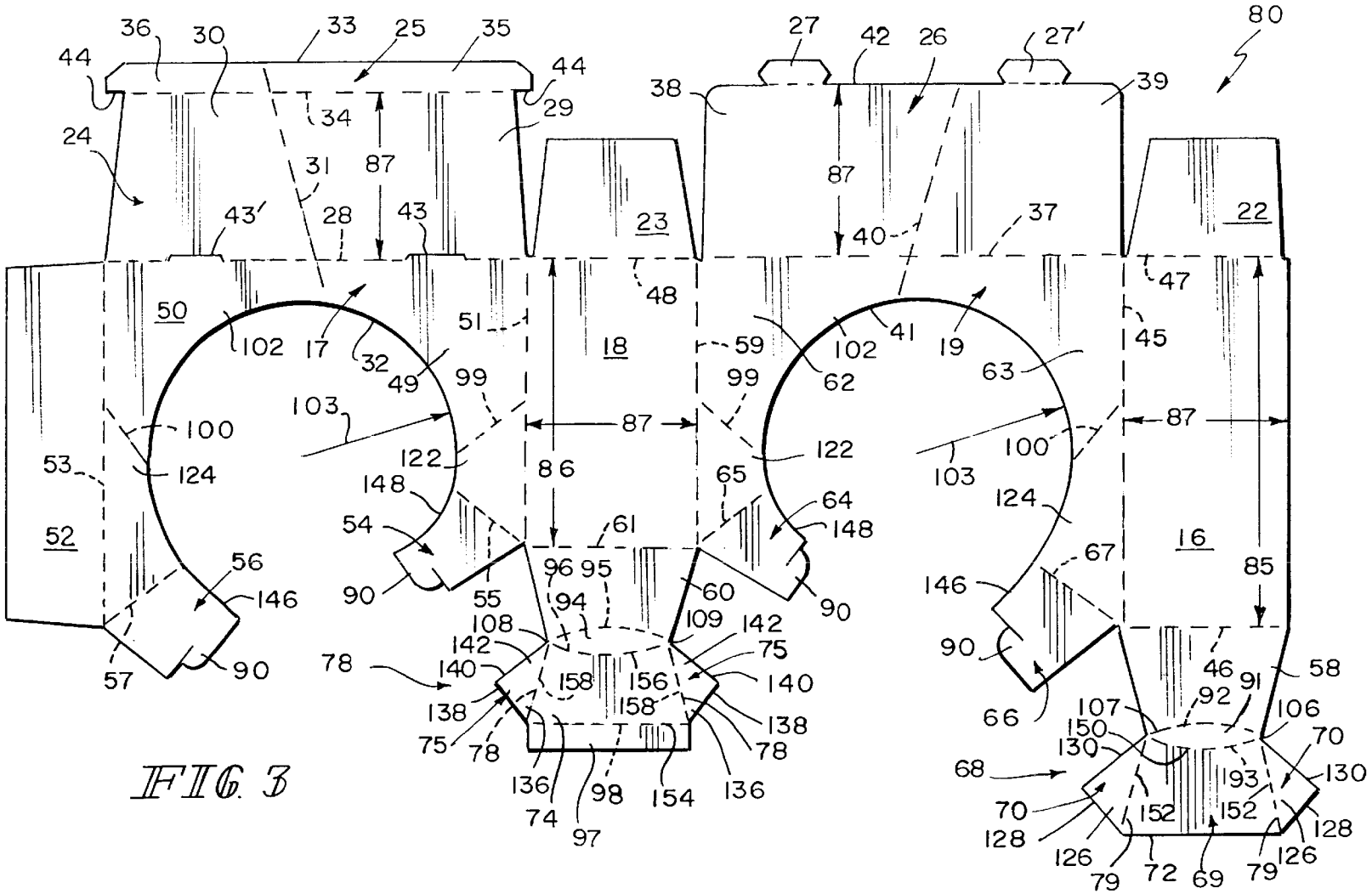
FIG. 3 is a top plan view of a blank used to form the container of FIG. 1 showing the blank including the bottom panel at the far right, the right and left side panels, the top panel positioned therebetween, and flaps that form the rear panel and the upper and lower front panels.

Container 10 is made of corrugated paperboard material and is folded from a blank 80, as shown, for example, in FIG. 3. FIGS. 4–8 and 10 show blank 80 folded into container 10. In illustrative embodiments, ball 11 is loaded into container 10 through the rear of container 10, as discussed in more detail below.

Figure 2:
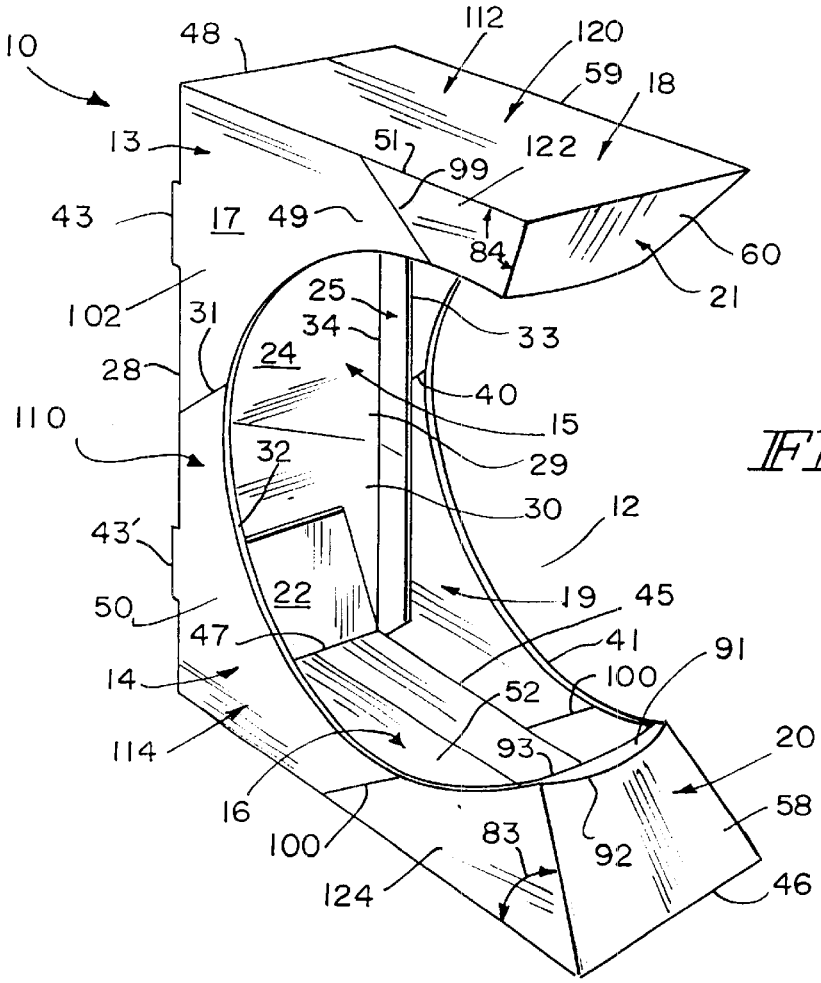
FIG. 2 is a perspective view of the container of FIG. 1 without the inflatable ball showing the container including a C-shaped left side panel, a C-shaped right side panel, a top panel, a bottom panel, a rear panel, an angled upper front panel, and an angled lower front panel, and further showing score lines formed in the left and right side panels and rear panel.

Container 10 includes upper and lower arms 13, 14 configured to hold ball 11 in place, as shown, for example, in FIGS. 1–2. Upper arm 13 is somewhat inverted L-shaped. Lower arm 14 is somewhat upright L-shaped. Container 10 further includes a rear panel or wall 15, a bottom panel or wall 16, a C-shaped left side panel or wall 17, a top panel or wall 18, a C-shaped right side panel or wall 19, an angled lower front panel or wall 20, and an angled upper front panel or wall 21. Bottom and top panels 16, 18 are positioned to lie at generally right angles to rear panel 15. Panels 15, 16, 18, 20, 21 cooperate to define a connector 120 that is coupled to left and right side panels 17, 19.

Container 10 may also be described as having a vertical post 110 and top and bottom arms 112, 114 cantilevered to vertical post 110, as shown, for example, in FIGS. 1 and 2.

Figure 9:
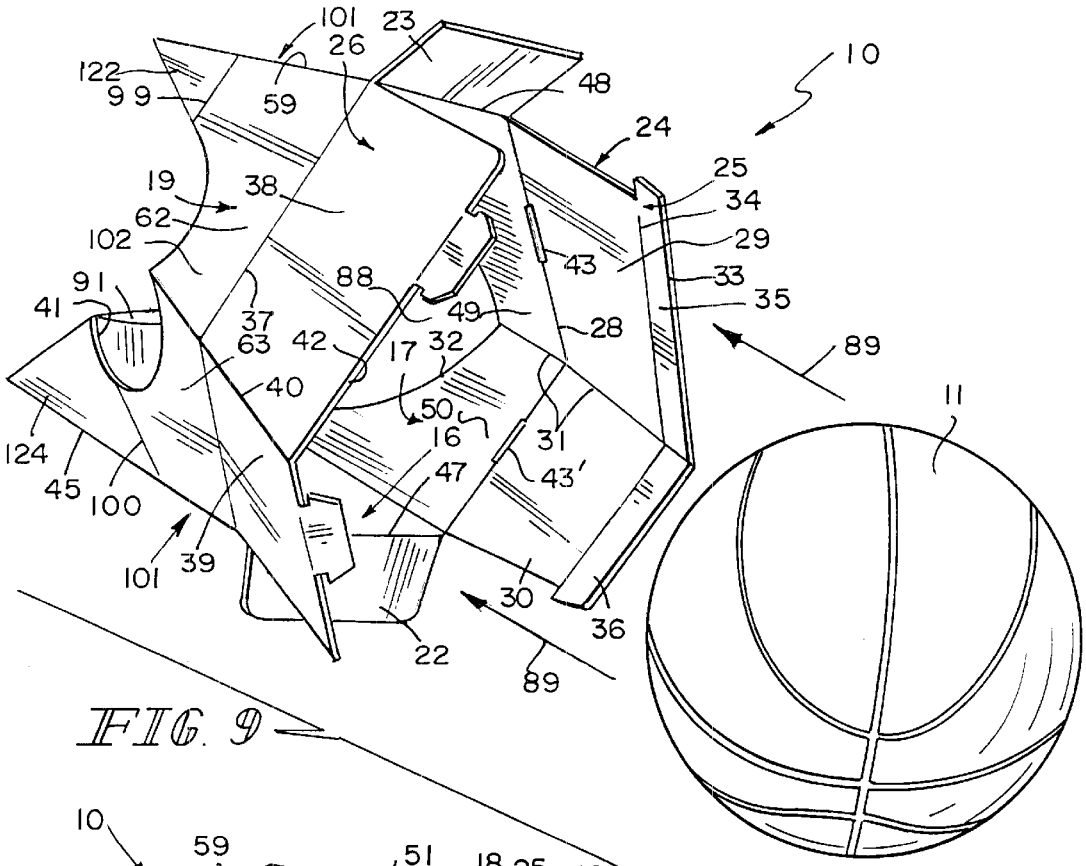
FIG. 9 is a perspective view of the container of FIG. 2 showing the container in a product-receiving position wherein the flaps of the rear panel are opened and the left and right side panels and sections of the rear panel flare away from one another along the rearward score lines to form a product-receiving opening sized to receive the inflatable ball.
Figure 10:
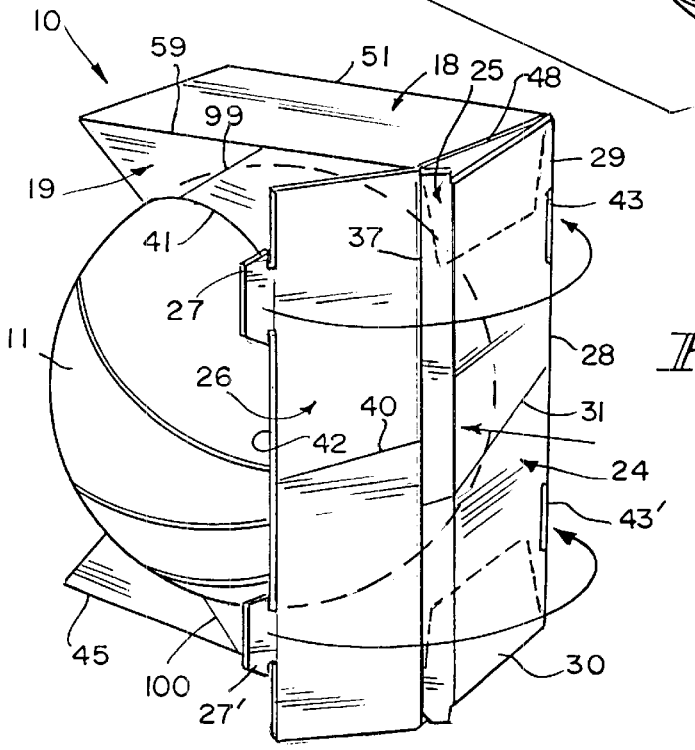
FIG. 10 is a perspective view of the container of FIG. 9 showing the rear panel being formed after insertion of the inflatable ball through the product-receiving opening into the C-shaped opening.

Rear panel 15 includes a lower rear flap 22, an upper rear flap 23, a left rear flap 24, an outer rear flap 25, a right rear flap 26, and a pair of rear tabs 27, 27', as shown, for example, in FIGS. 3, 9, and 10. Lower rear flap 22 is trapezoid-shaped and appendant to a rear edge of bottom panel 16 at a fold line 47 or pivotable movement relative to bottom panel 16. Similarly, upper rear flap 23 is trapezoid-shaped and appendant to a rear edge of top panel 18 at a fold line 48 for pivotable movement relative to top panel 18. Left rear flap 24 and outer rear flap 25 cooperate to define a first rear section. Right rear flap 26 and rear tabs 27, 27' cooperate to define a second rear section.

Left rear flap 24 is trapezoid-shaped and is appendant to a rear edge of left side panel 17 at a fold line 28 for pivotable movement relative to left side panel 17, as shown, for example, in FIGS. 3, 4, 9, and 10. Upper and lower sections 29, 30 are divided by a first crease or score line 31, which accommodates insertion of ball 11 into container 10, as discussed in more detail below. First score line 31 angles somewhat downwardly from a C-shaped edge 32 of left side panel 17 through left side panel 17, left rear flap 24 and outer rear tab 25 to an outer edge 33 of outer rear tab 25. First score line 31 is positioned to lie in non-parallel relation to the respective paperboard corrugations to minimize tearing along score line 31 (the paperboard corrugations of components of container 10 are parallel to the respective shade lines shown in the drawings). In illustrative embodiments, first score line 31 is horizontal so as to be parallel with the respective paperboard corrugations.

Outer rear tab 25 is appendant to an edge of left rear flap 24 at a fold line 34 for pivotable movement relative to left rear flap 24, as shown, for example, in FIGS. 3, 4, 9, and 10. Outer rear tab 25 includes an upper section 35 and a lower section 36, which are divided by first score line 31. Outer rear tab 25 further includes lower and upper locking edges 44 that extend away from left rear flap 24 to lock against lower and upper rear flaps 22, 23, respectively.

Right rear flap 26 is rectangle-shaped and is appendant to a rear edge of right side panel 19 at a fold line 37 for pivotable movement relative to right side panel 19, as shown, for example, in FIGS. 3, 4, 9, and 10. Right rear flap 26 includes an upper section 38 and a lower section 39. Upper and lower sections 38, 39 are divided by a second score line 40, which accommodates insertion of ball 11 into container 10, as discussed in more detail below. Second score line 40 angles somewhat downwardly from a C-shaped edge 41 of right side panel 19 through right side panel 19 and right rear flap 26 to an outer edge 42 of right rear flap 26. Score line 40 is positioned to lie in non-parallel relation to the respective paperboard corrugations to minimize tearing along score line 40. In illustrative embodiments, second score line 40 is horizontal so as to be parallel with the respective paperboard corrugations.

Rear tabs 27, 27' are appendant to outer edge 42 of right rear flap 26 for pivotable movement relative to right rear flap 26, as shown, for example, in FIGS. 3, 4, 9, and 10. Rear tab 27 is appendant to upper section 38 of right rear flap 26. Rear tab 27' is appendant to lower section 39 of right rear flap 26. Rear tabs 27, 27' are sized to fit within a pair of slots 43, 43', respectively, formed in fold line 28 between left side panel 17 and left rear flap 24.

Bottom panel 16 is rectangle-shaped and provides a floor for container 10, as shown, for example, in FIGS. 2–4, 7, and 8. A right edge of bottom panel 16 is appendant to a bottom edge of right side panel 19 at a fold line 45. A front edge of bottom panel 16 is appendant to a lower first trapezoid-shaped flap 58 of lower front panel 20 at a fold line 46. The rear edge of bottom panel 16 is appendant to lower rear flap 22 at fold line 47.

Figure 4:
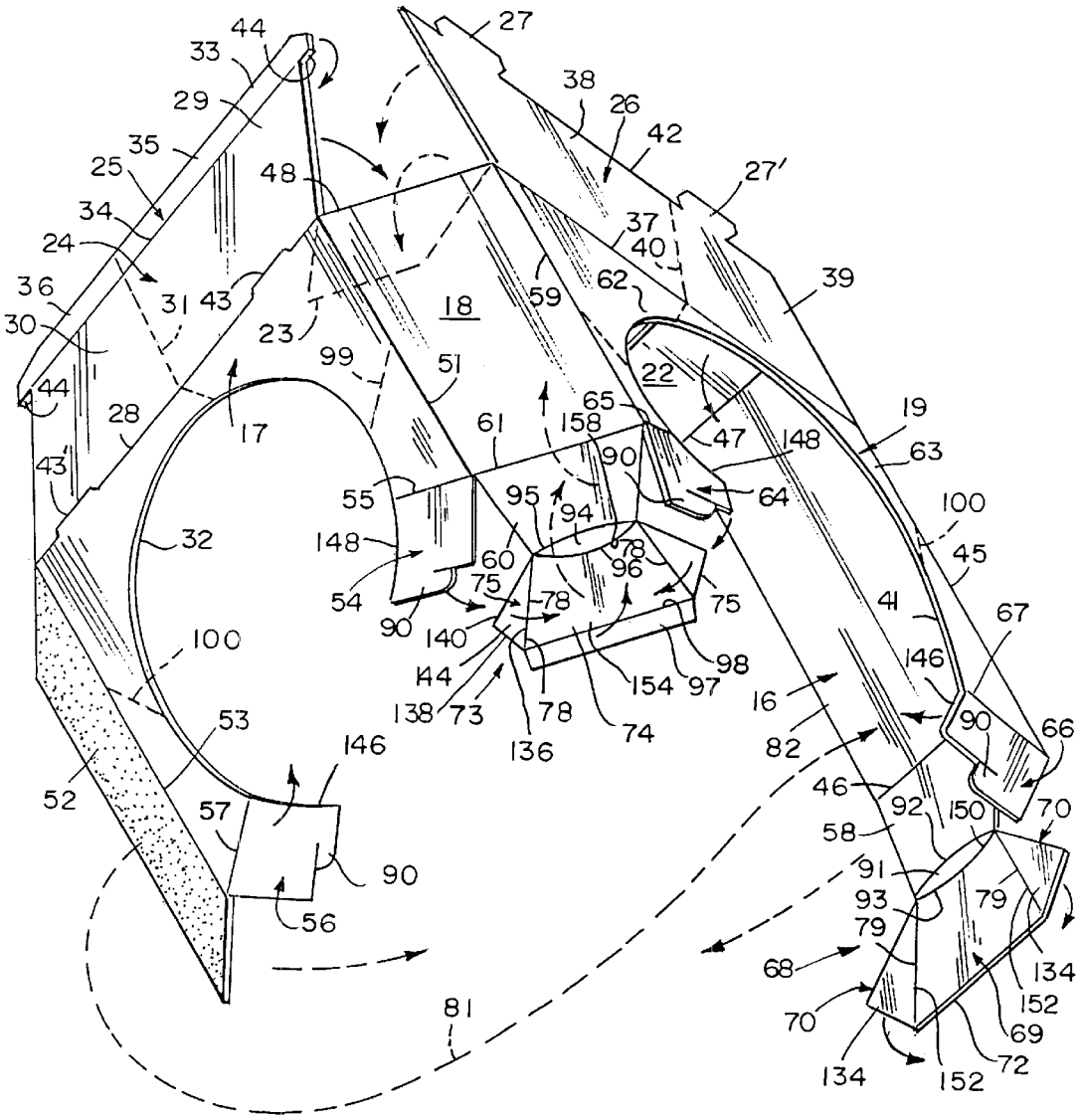
FIG. 4 is a perspective view of the blank of FIG. 5 showing the blank being folded to form the display container of FIG. 1.

Left side panel 17 includes an upper section 49 and a lower section 50 and is formed to include C-shaped edge 32, as shown, for example, in FIGS. 2–4. Upper and lower sections 49, 50 are divided by first score line 31. The rear edge of left side panel 17 is appendant to left rear flap 24 at fold line 28. A top edge of left side panel 17 is appendant to a left edge of top panel at a fold line 51. A bottom edge of left side panel 17 is appendant to a connector flap 52 at a fold line 53 (connector flap 52 is considered part of bottom panel 16 when connector flap 52 is coupled to bottom panel 16).

C-shaped edge 32 defines a radius of curvature 103, as shown, for example, in FIG. 3. C-shaped edge 32 includes a top end 116 and a bottom end 118, as shown, for example, in FIGS. 5 and 7. Similarly, C-shaped edge 41 has radius of curvature 103 and includes a top end 116 and a bottom end 118, as shown, for example, in FIGS. 3, 5, and 7. Top ends 116 are spaced apart from one another by a first distance 104 and bottom ends 118 are spaced apart from one another by a second distance 105, as shown, for example, in FIGS. 5 and 7.

Figure 5:
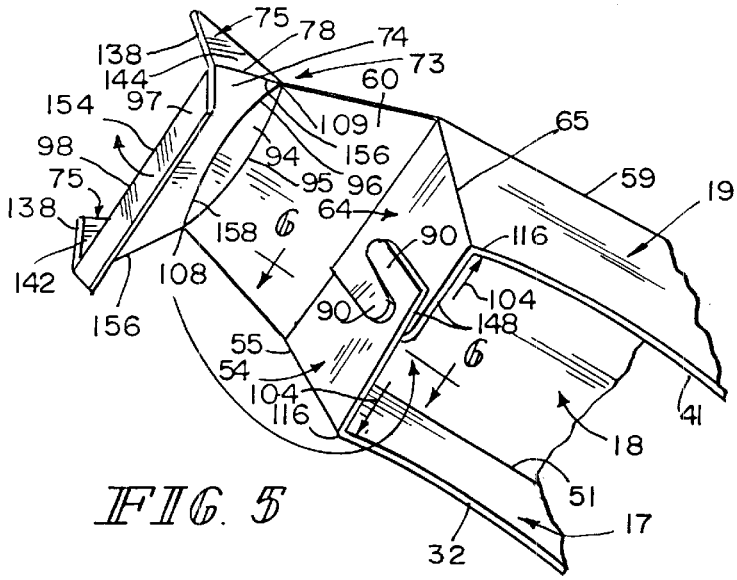
FIG. 5 is a perspective view of the flaps of the upper front panel of FIG. 2 showing those flaps being folded to form the upper front panel, the upper front panel including left and right side flaps that interlock with one another, a support surface for the inflatable ball, and a pair of support flaps.
Figure 7:
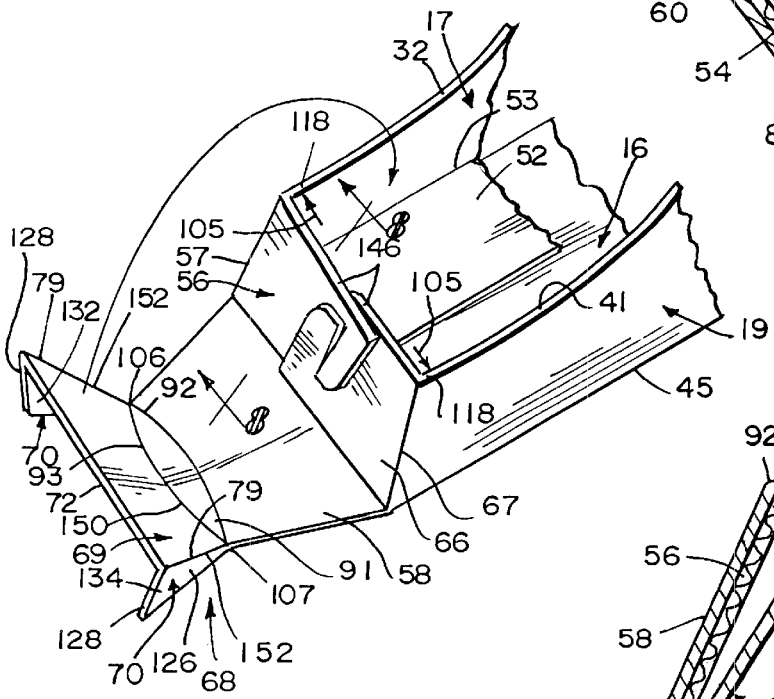
FIG. 7 is a perspective view of the flaps of the lower front panel of FIG. 2 showing those flaps being folded to form the lower front panel, the lower front panel including left and right side flaps that interlock with one another, a support surface for the inflatable ball, and a pair of support flaps.

Each of C-shaped edges 32, 41 includes atop end 116 and a bottom end 118, as shown, for example, in FIGS. 5 and 7.

An angled upper front edge of left side panel 17 is appendant to an upper left side flap 54 at an angled fold line 55 for pivotable movement of upper left side flap 54 relative to left side panel 17. Fold line 55 angles from fold line 51 to C-shaped edge 32.

An angled lower front edge of left side panel 17 is appendant to a lower left side flap 56 at an angled fold line 57 for pivotable movement of lower left side flap 56 relative to left side panel 17. Fold line 57 angles from fold line 53 to C-shaped edge 32.

Top panel 18 is rectangle-shaped and is coupled to left and right side panels 17, 18, rear panel 15, and upper front panel 21, as shown, for example, in FIGS. 1–4 and 10. The left edge of top panel 18 is appendant to the top edge of left side panel 17 at a fold line 51. A right edge of top panel 18 is appendant to a top edge of right side panel 19 at a fold line 59. A front edge of top panel 18 is appendant to an upper first trapezoid-shaped flap 60 of upper front panel 21 at a fold line 61. The rear edge of top panel 18 is appendant to upper rear flap 23 at fold line 48.

Right side panel 19 includes an upper section 62 and a lower section 63 and is formed to include C-shaped edge 41, as shown, for example, in FIGS. 3, 4, 9, and 10. Upper and lower sections 62, 63 are divided by second score line 40. The rear edge of right side panel 19 is appendant to right rear flap 26 at fold line 37. The top edge of right side panel 19 is appendant to the right edge of top panel at fold line 59. The bottom edge of right side panel 19 is appendant to the right edge of bottom panel 16 at fold line 45.

An angled upper front edge of right side panel 19 is appendant to a lower right side flap 64 at an angled fold line 65 for pivotable movement of upper right side flap 64 relative to right side panel 19. Fold line 65 angles from fold line 59 to C-shaped edge 41.

An angled lower front edge of right side panel 19 is appendant to a lower right side flap 66 at an angled fold line 67 for pivotable movement of lower right side flap 66 relative to right side panel 19. Fold line 57 angles from fold line 53 to C-shaped edge 32.

Each of left side panel 17 and right side panel 19 includes an upper crease or score line 99 and a lower crease or score line 100, as shown, for example, in FIGS. 2, 3, and 10. Score lines 99 and 100 accommodate entry of ball 11 into container 10, as discussed in more detail below. Upper score line 99 of left side panel 17 angles rearwardly from an uppermost location of C-shaped edge 32 to a middle location of fold line 51. Similarly, upper score line 99 of right side panel 19 angles rearwardly from an uppermost location of C-shaped edge 41 to a middle location of fold line 59. Lower score line 100 of left side panel 17 angles rearwardly from a lowermost location of C-shaped edge 32 to a middle location of fold line 53. Similarly, lower score line 100 of right side panel 19 angles rearwardly from a lowermost location of C-shaped edge 41 to a middle location of fold line 45.

Score lines 99 and 100 of left side panel 17 are positioned to lie in non-parallel relation to the paperboard corrugations of left side panel 17, which extend parallel to the shade lines on left side panel 17, as shown, for example, in FIG. 3. Similarly, score lines 99 and 100 of right side panel 19 are positioned to lie in non-parallel relation to the paperboard corrugations of right side panel 19, which extend parallel to the shade lines on right side panel 19, as shown, for example, in FIG. 3. In illustrative embodiments, container 10 is without score lines 99 and 100. Score lines 99, 100 are designed to relieve stress in container 10 that may be generated from interaction between the inflatable ball and container 10.

Score lines 99, 100 divide each of left and right side panels 17, 19 into a rearward section 102, an upper forward section 122, and a lower forward section 124, as shown, for example, in FIGS. 2, 3, and 9. Each rearward section 102 is bounded by score lines 99, 100 of respective side panel 17, 19, respective C-shaped edge 32, 41, and the rear, bottom, and top edges of respective side panel 17, 19. Each upper forward section 122 is bounded by respective score line 99, respective C-shaped edge 32, 41, and the top and angled upper front edges of respective side panel 17, 19. Each lower forward section 124 is bounded by respective score line 100, respective C-shaped edge 32, 41, and the bottom and angled lower front edges of respective side panel 17, 19. Rearward section 102 of left side panel 17 includes score line 31. Similarly, rearward section 102 of right side panel 19 includes score line 40.

Lower front panel 20 includes lower left side flap 56, lower right side flap 66, and a lower multi-segment flap 68, as shown, for example, in FIGS. 3, 4, 7, and 8. Each of lower left and right side flaps 56, 66 includes an Arthur lock or locking tab 90. Locking tabs 90 of lower left and right side flaps 56, 66 interlock with one another, as shown, for example, in FIG. 7, so that lower forward sections 124 taper toward one another. Lower left side flap 56 is appendant to the angled lower front edge of left side panel 17 at fold line 57. Lower right side flap 66 is appendant to the angled lower front edge of right side panel 19 at fold line 67. Each of lower left and right side flaps 56, 66 includes a curved edge 146.

Lower multi-segment flap 68 includes first lower trapezoid flap 58, a second lower trapezoid-shaped flap 69, a curved support surface 91 interconnecting flaps 58 and 69, and a pair of lower support flaps 70 that are triangle-shaped, as shown, for example, in FIGS. 3, 4, 7, and 8. Each of flaps 58 and 69 are somewhat trapezoid-shaped. Flap 58 includes a long edge appendant to the front edge of bottom panel 16 at fold line 46, a curved short edge positioned opposite from the respective long edge, and a pair of non-parallel edges. Flap 69 includes a long edge 72 that engages connector flap 52 to hold lower multi-segment flap 68 in place, a curved short edge 150 positioned opposite from long edge 72, and a pair of non-parallel edges 152. Curved support surface 91 is coupled to the short edge of flap 58 along a curved score line or fold line 92 and to short edge 150 of flap 69 along a curved score line or fold line 93 to interconnect flaps 58 and 69.

Curved support surface 91 is adapted to engage inflatable ball 11 when inflatable ball 11 is positioned in C-shaped opening 12. Curved support surface 91 includes a first juncture 106 and a second juncture 107, as shown, for example, in FIGS. 3 and 7. Fold lines 92 and 93 are coupled to one another at first juncture 106 and second juncture 107. First juncture 106 is positioned to lie adjacent to bottom end 118 of left side panel 17. Second juncture 107 is positioned to lie adjacent to bottom end 118 of right side panel 19.

Lower support flaps 70 are configured to reinforce curved support surface 91 when curved support surface 91 engages inflatable ball 11. Each lower support flap 70 includes a first edge 126, a second edge 128, a third edge 130, a first face 132, and a second face 134, as shown, for example, in FIGS. 3, 4, 7, and 8. Each first edge 126 is appended to a different one of the non-parallel edges 152 of second lower trapezoid flap 69 at a fold line 79 and extends from one of junctures 106, 107 to long edge 72. Each second edge 128 engages bottom panel 16 to support curved support surface 91. Each second face 134 engages one of left side panel 17 and right side panel 19 while first faces 132 face one another. In illustrative embodiments, each of lower support flaps 58 is offset from long edge 72.

Upper front panel 21 includes upper left side flap 54, upper right side flap 64, and an upper multi-segment flap 73, as shown, for example, in FIGS. 3–6. Each of upper left and right side flaps 54, 64 includes an Arthur lock or locking tab 90. Locking tabs 90 of upper left and right side flaps 54, 64 interlock with one another, as shown, for example, in FIG. 5, so that upper forward sections 122 taper toward one another. Upper left side flap 54 is appendant to the angled upper front edge of left side panel 17 at fold line 55. Upper right side flap 64 is appendant to the angled upper front edge of right side panel 19 at fold line 65. Each of upper left and right side flaps 54, 64 includes a curved edge 148.

Upper multi-segment flap 73 is similar to, but smaller than, lower multi-segment flap 68. Upper multi-segment flap 73 includes first upper trapezoid flap 60, a second upper trapezoid-shaped flap 74, a curved support surface 94 interconnecting flaps 60 and 74, and a pair of upper support flaps 75 that are triangle-shaped, as shown, for example, in FIGS. 3–6. Each of flaps 60 and 74 are somewhat trapezoid-shaped. Flap 60 includes a long edge appendant to the front edge of top panel 18 at fold line 61, a curved short edge positioned opposite from the respective long edge, and a pair of non-parallel edges. Flap 74 includes a long edge 154, a curved short edge 156 positioned opposite from long edge 154, and a pair of non-parallel edges 158. Curved support surface 94 is coupled to the short edge of flap 60 along a curved score line or fold line 95 and short edge 156 of flap 74 along a curved score line or fold line 96 to interconnect flaps 60 and 74.

Curved support surface 94 is adapted to engage inflatable ball 11 when inflatable ball 11 is positioned in C-shaped opening 12. Curved support surface 94 includes a first juncture 108 and a second juncture 109, as shown, for example, in FIGS. 3 and 5. Fold lines 95 and 96 are coupled to one another at first juncture 108 and second juncture 109. First juncture 108 is positioned to lie adjacent to top end 116 of left side panel 17. Second juncture 109 is positioned to lie adjacent to top end 116 of right side panel 19.

Upper multi-segment flap 73 further includes a drag lock flap 97 coupled to long edge 154 of flap 74 along a fold line 98, as shown, for example, in FIGS. 3–6. During assembly of upper front panel 21, drag lock flap 97 is folded along fold line 98 to frictionally engage top panel 18, as shown, for example, in FIG. 6, to hold upper multi-segment flap 73 in place. In illustrative embodiments, upper multi-segment flap 73 is without drag lock flap 97 and the long edge of flap 74 engages top panel 18 to assist in holding upper multi-segment flap 73 in place.

Upper support flaps 75 are configured to reinforce curved support surface 94 when curved support surface 94 engages inflatable ball 11. Each upper support flap 75 includes a first edge 136, a second edge 138, a third edge 140, a first face 142, and a second face 144, as shown, for example, in FIGS. 3, 4, 7, and 8. Each first edge 136 is appended to a different one of the non-parallel edges 158 of second upper trapezoid flap 74 at a fold line 78 and extends from one of junctures 108, 109 to fold line 98. Each second edge 138 engages top panel 18 to support curved support surface 94. Each second face 144 engages one of left side panel 17 and right side panel 19 while first faces 142 face one another. In illustrative embodiments, each of upper support flaps 75 is offset from fold line 98.

Bottom panel 16 is longer than top panel 18, as shown, for example, in FIG. 3. Bottom panel 16 includes a bottom panel length 85 and top panel 18 includes a top panel length 86 which is shorter than bottom panel length 85. This exposes surface area of ball 11 to a bystander viewing ball 11 from a location above ball 11 while providing a stable support for ball 11. In illustrative embodiments, top panel length 86 is about 7 inches (17.78 centimeters) and bottom panel length 85 is about 9 inches (22.86 centimeters).

Each of rear panel 15, bottom panel 16, and top panel 18 includes a width 87, as shown, for example, in FIG. 3. Width 87 is designed to be less than a diameter of ball 11 to permit container 10 to expose surface area of ball 11 to a bystander while sufficiently supporting ball 11. Width 87 is less than twice radius of curvature 103 of C-shaped edges 32, 41. In illustrative embodiments, width 87 is about 4.125 inches (10.478 centimeters). Width 87 is greater than first distance 104 between top ends 116 of edges 32, 41 and is greater than second distance 105 between bottom ends 118 of edges 32, 41.

Upper arm 13 is formed by those portions of container 10 positioned to lie above first and second score lines 31, 40 whereas lower arm 14 is formed by those portions of container 10 positioned to lie below first and second score lines 31, 40. Upper front panel 21, upper sections 29, 35, 38, 49, 62, upper rear flap 23, rear tab 27, and slot 43 cooperate to define upper arm 13. Lower front panel 20, lower sections 30, 36, 39, 50, 63, lower rear flap 22, rear tab 27', and slot 43' cooperate to define lower arm 14.

Blank 80 can be folded into container 10 as shown, for example, in FIGS. 4–8 and 10. Starting with blank 80 in the orientation shown in FIG. 3, connector flap 52 is moved toward bottom panel 16 as indicated by arrow 81, as shown, for example, in FIG. 4. Connector flap 52 is glued to a left portion 82 of bottom panel 16 so that connector flap 52 becomes part of bottom panel 16. Container 10 is then stood upright so that bottom panel 16 engages the support surface.

Figure 8:
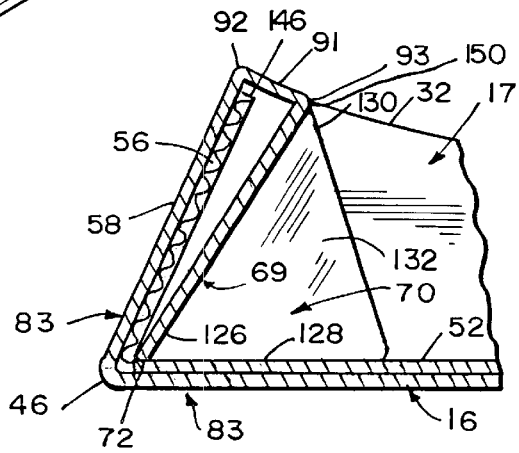
FIG. 8 is a sectional view of the lower front panel taken along line 8—8 of FIG. 7 showing the arrangement of flaps of the lower front panel and, in particular, one of the support flaps engaging the bottom panel to reinforce the support surface.

Lower front panel 20 is formed as shown, for example, in FIGS. 7 and 8. Lower left and right side flaps 56, 66 are folded rearwardly along fold lines 57, 67, respectively, and locking tabs 90 of flaps 56, 66 are interlocked. Lower multi-segment flap 68 is then wrapped over lower left and right side flaps 56, 66 along fold lines 46, 92, 93. Lower support flaps 70 are positioned to contact bottom panel 16. Flaps 70 point rearwardly, as shown, for example, in FIG. 8. Long edge 72 engages bottom panel 16 to hold lower front panel 20 together, thus completing the formation of lower front panel 20.

Lower front panel 20 forms an angle 83 with bottom panel 16 to provide exposure to the surface area of ball 11, as shown, for example, in FIGS. 2 and 8. In illustrative embodiments, angle 83 is about 49°. The trapezoid shape of lower front panel 20 and the interlocking of flaps 56, 66 cause lower forward sections 124 of left and night side panels 17, 19 to taper toward one another as they approach lower front panel 20.

Figure 6:
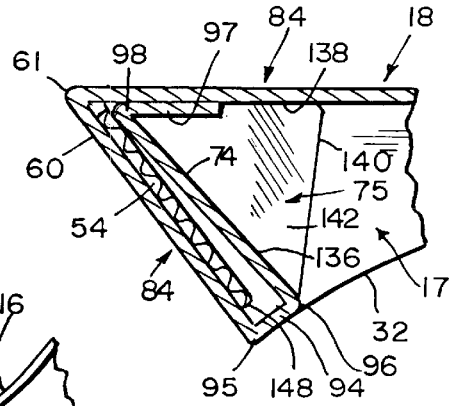
FIG. 6 is a sectional view of the upper front panel taken along line 6—6 of FIG. 5 showing the arrangement of flaps of the upper front panel and, in particular, one of the support flaps engaging the top panel to reinforce the support surface.

Upper front panel 21 is formed similar to lower front panel 20, as shown, for example, in FIGS. 5 and 6. Upper left and right side flaps 54, 64 are folded rearwardly along fold lines 55, 65, respectively, and locking tabs 90 of flaps 54, 64 are interlocked so that one overlaps the other. Upper multi-segment flap 73 is then wrapped over upper left and right side flaps 54, 64 along fold lines 61, 95, 96, 98. Upper support flaps 75 are positioned to contact top panel 18. Flaps 75 point rearwardly, as shown, for example, in FIG. 14. Drag lock flap 97 engages top panel 18 to hold upper front panel 21 together, thus completing the formation of upper front panel 21.

Upper front panel 20 forms an angle 84 with bottom panel 16 to provide exposure to the surface area of ball 11, as shown, for example, in FIGS. 2 and 6. In illustrative embodiments, angle 84 is about 49°. Similar to lower front panel 20, the trapezoid shape of upper front panel 21 and the interlocking of flaps 54, 64 cause upper forward sections 122 of left and right side panels 17, 19 to taper toward one another as they approach upper front panel 21.

Container 10 is configured to receive ball 11 when container 10 is in a product-loading position, as shown, for example, in FIG. 9. Inflatable ball 11 is inserted into C-shaped opening 12 through a product-receiving opening 88 at the rear of container 10 in direction 89 after lower and upper front panels 20, 21 are formed but before rear panel 15 is formed, as shown, for example, in FIGS. 9 and 10.

A force 101 is imposed on bottom and top panels 16, 18 to form product-receiving opening 88, as shown, for example, in FIG. 9. For example, when bottom panel 16 is placed on a support surface, force 101 can be exerted on top panel 16 to move a portion of top panel 16 toward bottom panel 18. This causes rearward sections 102 to flare away from one another along score lines 31, 40 and to move relative to forward sections 122, 124 along score lines 99, 100. At the same time, left and right rear flaps 24, 26 and outer rear tab 25 flare outwardly along score lines 31, 40 with rearward sections 102. Score lines 31, 40, 99, 100, thus, accommodate loading of ball 11 into container 10. Since each of score lines 31, 40, 99, 100 is non-parallel to respective paperboard corrugations, the likelihood of stress cracks or tears occurring during loading of ball 11 into container 11 is limited.

After ball 11 is inserted into container 10, rear panel 15 is formed as shown in FIGS. 4 and 10. Lower and upper rear flaps 22, 24 are folded forwardly along fold lines 47, 48, respectively. Left rear flap 24 is then folded forwardly along fold line 28. Outer rear tab 25 is tucked between right side panel 19 and lower and upper rear flaps 22, 24 such that locking edges 44 engage lower and upper rear flaps 22, 24 to maintain left rear flap 24 closed. Right rear flap 26 is then folded forwardly along fold line 37 and rear tabs 27, 27' are tucked in slots 43, 43', respectively, to maintain right rear flap 26 closed, thus completing the formation of rear panel 15.

C-shaped edges 32, 41 and curved support surfaces 91, 94 contact inflatable ball 11 once inflatable ball 11 is positioned in C-shaped opening 12. Curved support surfaces 91, 94 cooperate to trap the inflatable ball 11 in place to prevent inflatable ball 11 from rotating in container 10.

Although the invention has been described in detail with reference to illustrative embodiments, variations and modifications exist within the scope and spirit of the invention as defined in the following claims.

What is claimed is:

1. A display container for displaying a spherical article, the display container comprising a left side panel, a right side panel, each of the left and right side panels including a curved edge adapted to engage the spherical article, the curved edges cooperating to provide means for defining a C-shaped opening to receive the spherical article therein, and a connector including a top panel, a bottom panel, an upper front panel, and a lower front panel, the top panel, the bottom panel, the upper front panel, and the lower front panel being coupled to the left side panel and the right side panel, the upper front panel includes a first flap coupled to the top panel, a second flap, a support surface coupled to the first and second flaps of the upper front panel and adapted to engage the spherical article when the spherical article is positioned in the C-shaped opening, and a first support flap that is coupled to the second flap of the upper front panel and engages the top panel so that the first support flap of the upper front panel reinforces the support surface of the upper front panel, the lower front panel including a first flap coupled to the bottom panel, a second flap, a support surface coupled to the first and second flaps of the lower front panel and adapted to engage the spherical article when the spherical article is positioned in the C-shaped opening, and a first support flap that is coupled to the second flap of the lower front panel and engages the bottom panel so that the first support flap of the lower front panel reinforces the support surface of the lower front panel.

2. The display container of claim 1, wherein each support flap includes an edge coupled to the respective second flap along a first fold line.

3. The display container of claim 2, wherein the support flap of the upper front panel includes an edge that engages the top panel and the support flap of the lower front panel includes an edge that engages the bottom panel.

4. The display container of claim 1, wherein each support flap includes a first edge, a second edge, and a third edge which cooperate with one another so that the support flap is triangle-shaped, the first edge is coupled to the respective second flap along a fold line, and the second edge engages one of the top panel and the bottom panel.

5. The display container of claim 1, wherein the upper front panel further includes a second support flap that is coupled to the second flap of the upper front panel and engages the top panel so that the second support flap of the upper front panel reinforces the support surface of the upper front panel and the lower front panel further includes a second support flap that is coupled to the second flap of the lower front panel and engages the bottom panel so that the second support flap of the lower front panel reinforces the support surface of the lower front panel.

6. The display container of claim 5, wherein each of the support flaps includes a first face and a second face, the first faces of the support flaps of the upper front panel face one another, the second faces of the support flaps of the upper front panel face away from one another, the first faces of the support flaps of the lower front panel face one another, and the second faces of the support flaps of the lower front panel face away from one another.

7. The display container of claim 6, wherein the second faces of the first support flaps engage the left side panel and the second faces of the second support flaps engage the right side panel.

8. The display container of claim 5, wherein each second flap includes a first edge, a second edge, and a third edge, the first edge of the second flap of the upper front panel is coupled to the support surface of the upper front panel, the second edge of the second flap of the upper front panel is coupled to the first support flap of the upper front panel, the third edge of the second flap of the upper front panel is coupled to the second support flap of the upper front panel, the first edge of the second flap of the lower front panel is coupled to the support surface of the lower front panel, the second edge of the second flap of the lower front panel is coupled to the first support flap of the lower front panel, and the third edge of the second flap of the lower front panel is coupled to the second support flap of the lower front panel.

9. The display container of claim 8, wherein each second flap includes a fourth edge coupled to the second and third edges, the first and second support flaps of the upper front panel extend from the first edge of the second flap of the upper front panel to the fourth edge of the second flap of the upper front panel, and the first and second support flaps of the lower front panel extend from the first edge of the second flap of the lower front panel to the fourth edge of the second flap of the lower front panel.

10. The display container of claim 1, wherein the connector further includes a rear panel coupled to the left side panel, the right side panel, the top panel, and the bottom panel, and each support flap extends from the respective second flap toward the rear panel.

11. A display container for displaying a spherical article, the display container comprising a left side panel, a right side panel, each of the left and right side panels including a curved edge adapted to engage the spherical article, the curved edges cooperating to provide means for defining a C-shaped opening to receive the spherical article therein, and a connector including an upper front panel and a lower front panel, each of the upper front panel and the lower front panel including a left side flap and a right side flap, the left side flaps being coupled to the left side panel, the right side flaps being coupled to the right side panel, the left and right side flaps of the upper front panel interlocking with one another and the left and right side flaps of the lower front panel interlocking with one another so that sections of the left and right side panels taper toward one another.

12. The display container of claim 11, wherein each of the left and right side flaps includes a tab, the tabs of the left and right side flaps of the upper front panel interlock with one another, and the tabs of the left and right side flaps of the lower front panel interlock with one another.

13. The display container of claim 12, wherein the tabs of the left and right side flaps are Arthur locks.

14. The display container of claim 11, wherein each of the left and right side panels includes an upper forward section and a lower forward section, the upper and lower forward sections of the left side panel cooperate to define the curved edge of the left side panel in part, the upper and lower forward sections of the right side panel cooperate to define the curved edge of the right side panel in part, the left side flap of the upper front panel is coupled to the upper forward section of the left side panel, the right side flap of the upper front panel is coupled to the upper forward section of the right side panel, the left side flap of the lower front panel is coupled to the lower forward section of the left side panel, and the right side flap of the lower front panel is coupled to the lower forward section.

15. The display container of claim 14, wherein the upper forward sections taper toward one another in response to the left and right side flaps of the upper front panel interlocking with one another and the lower forward sections taper toward one another in response to the left and right side flaps of the lower front panel interlocking with one another.

16. The display container of claim 11, wherein the connector further includes a top panel and a bottom panel which are coupled to the left and right side panels, the left side flap of the upper front panel angles rearwardly from the top panel to the curved edge of the left side panel, the right side flap of the upper front panel angles rearwardly from the top panel to the curved edge of the right side panel, the left side flap of the lower front panel angles rearwardly from the bottom panel to the curved edge of the left side panel, and the right side flap of the lower front panel angles rearwardly from the bottom panel to the curved edge of the right side panel.

17. The display container of claim 11, wherein the upper front panel further includes a first flap, a second flap, and a curved support surface coupled to the first and second flaps, the lower front panel further includes a first flap, a second flap, and a support surface coupled to the first and second flaps, the curved support surfaces are adapted to engage the spherical article when the spherical article is positioned in the C-shaped opening, the first flap, the second flap, and the support surface of the upper front panel cooperate to cover the left and right side flaps of the upper front panel, and the first flap, the second flap, and the support surface of the lower front panel cooperate to cover the left and right side flaps of the lower front panel.

18. The display container of claim 17, wherein each of the left and right side flaps of the upper front panel includes a lower curved edge, each of the left and right side flaps of the lower front panel includes an upper curved edge, the curved support surface of the upper front panel extends along the lower curved edges, and the curved support surface of the lower front panel extends along the upper curved edges.

19. A display container for displaying a spherical article, the display container comprising a left side panel, a right side panel, each of the left and right side panels including a curved edge adapted to engage the spherical article, the curved edges cooperating to provide means for defining a C-shaped opening to receive the spherical article therein, a connector coupled to the left and right side panels, each of the left side panel and the right side panel including a first score line, the first score line of the left side panel extending from the curved edge of the left side panel to the connector, the first score line of the right side panel extending from the curved edge of the right side panel to the connector.

20. The display container of claim 19, wherein the connector includes a top panel, a bottom panel, and a rear panel, the top panel, the bottom panel, and the rear panel are coupled to the left side panel and the right side panel, and each of the first score lines extends to one of the top panel, the bottom panel, and the rear panel.

21. The display container of claim 19, wherein each of the left side panel and the right side panel includes a second score line, the second score line of the left side panel extends from the curved edge of the left side panel to the connector, and the second score line of the right side panel extends from the curved edge of the right side panel to the connector.

22. The display container of claim 21, wherein the connector includes a top panel, a bottom panel, and a rear panel, the top panel, the bottom panel, and the rear panel are coupled to the left side panel and the right side panel, each of the first score lines extends to one of the top panel, the bottom panel, and the rear panel, and each of the second score lines extends to a different one of the top panel, the bottom panel, and the rear panel.

23. The display container of claim 21, wherein each of the left side panel and the right side panel includes a third score line, the third score line of the left side panel extends from the curved edge of the left side panel to the connector, and the third score line of the right side panel extends from the curved edge of the right side panel to the connector.

24. The display container of claim 23, wherein the connector includes a top panel, a bottom panel, and a rear panel, the top panel, the bottom panel, and the rear panel are coupled to the left side panel and the right side panel, each of the first score lines extends to the top panel, each of the second score lines extends to the bottom panel, and each of the third score lines extends to the rear panel.

25. The display container of claim 24, wherein the rear panel includes a first section including a first edge coupled to the left side panel and a second edge and a second section including a first edge coupled to the right side panel and a second edge, the third score line of the left side panel extends past the first edge of the first section of the rear panel to the second edge of the first section of the rear panel, and the third score line of the right side panel extends past the first edge of the second section of the rear panel to the second edge of the second section of the rear panel.

26. The display container of claim 23, wherein each of the left and right side panels includes paperboard corrugations, the first score line, the second score line, and the third score line of the left side panel are non-parallel to the paperboard corrugations of the left side panel, and the first score line, the second score line, and the third score line of the right side panel are non-parallel to the paperboard corrugations of the right side panel.

27. The display container of claim 21, wherein the first score line of the left side panel extends from an uppermost portion of the curved edge of the left side panel, the first score line of the right side panel extends from an uppermost portion of the curved edge of the right side panel, the second score line of the left side panel extends from a lowermost portion of the curved edge of the left side panel, and the second score line of the right side panel extends from a lowermost portion of the curved edge of the right side panel.

28. The display container of claim 19, wherein the connector includes a rear panel including a first section coupled to the left side panel and a second section coupled to the right side panel, the first score line of the left side panel extends beyond the left side panel into the first section of the rear panel, and the first score line of the right side panel extends beyond the right side panel into the second section of the rear panel.

29. The display container of claim 28, wherein the first section of the rear panel includes a first edge coupled to the left side panel and a second edge, the second section of the rear panel includes a first edge coupled to the right side panel and a second edge, the first score line of the left side panel extends past the first edge of the first section of the rear panel to the second edge of the first section of the rear panel, and the first score line of the right side panel extends past the first edge of the second section of the rear panel to the second edge of the second section of the rear panel.

30. The display container of claim 19, wherein the first score lines are arranged to allow the left and right side panels to move away from one another along the first score lines to facilitate insertion of the spherical article into the C-shaped opening.

31. The display container of claim 19, wherein the first score lines are positioned to provide stress relief for the display container.

32. A display container for displaying a spherical article, the display container comprising a left side panel, a right side panel, each of the left and right side panels including a curved edge adapted to engage the spherical article, the curved edges cooperating to provide means for defining a C-shaped opening to receive the spherical article therein, a connector including a top panel, a bottom panel, an upper front panel, and a lower front panel, the top and bottom panels being coupled to the left and right side panels, the upper front panel including a first flap coupled to the top panel, a second flap, and a curved support surface coupled to the first flap of the upper front panel along a first curved score line and to the second flap of the upper front panel along a second curved score line and adapted to engage the spherical article when the spherical article is positioned in the C-shaped opening, the lower front panel including a first flap coupled to the bottom panel, a second flap, and a curved support surface coupled to the first flap of the lower front panel along a third curved score line and to the second flap of the lower front panel along a fourth curved score line and adapted to engage the spherical article when the spherical article is positioned in the C-shaped opening, each of the first, second, third, and fourth curved score lines extending from the curved edge of the left side panel to the curved edge of the right side panel.

33. The display container of 32, wherein each of the curved support surfaces of the upper and lower front panels is concave.

34. The display container of 32, wherein the first and second curved score lines are coupled to one another at a first juncture and the third and fourth curved score lines are coupled to one another at a second juncture.

35. The display container of 34, wherein the first and second curved score lines are coupled to one another at a third juncture spaced apart from the first juncture and the third and fourth curved score lines are coupled to one another at a fourth juncture spaced apart from the second juncture.

36. The display container of claim 35, wherein each of the curved edges of the left and right side panels includes an upper end and a lower end, the first juncture is positioned adjacent to the upper end of the curved edge of the left side panel, the second juncture is positioned adjacent to the lower end of the curved edge of the left side panel, the third juncture is positioned adjacent to the upper end of the curved edge of the right side panel, and the fourth juncture is positioned adjacent to the lower end of the curved edge of the right side panel.

37. The display container of claim 36, wherein the first flap of the upper front panel is coupled to the top panel along a first fold line that extends a first distance from the left side panel to the right side panel, the first flap of the lower front panel is coupled to the bottom panel along a second fold line that extends the first distance from the left side panel to the right side panel, the first and third junctures are spaced apart from one another by a second distance that is less than the first distance, and the second and fourth junctures are spaced apart from one another by a third distance that is less than the first distance.

38. The display container of claim 32, wherein each of the curved edges of the left and right side panels includes a first end and a second end, the first and second curved score lines extend from the first end of the left side panel to the first end of the right side panel, and the third and fourth curved score lines extend from the second end of the left side panel to the second end of the right side panel.

39. The display container of claim 32, wherein each of the upper and lower front panels includes first and second support flaps, the first and second support flaps of the upper front panel is coupled to the second flap of the upper front panel and engages the top panel, and the first and second support flaps of the lower front panel is coupled to the second flap of the lower front panel and engages the bottom panel.

40. The display container of claim 39, wherein the first and second support flaps of the upper front panel extend from the curved support surface of the upper front panel to the top panel and the first and second support flaps of the lower front panel extend from the curved support surface of the lower front panel to the bottom panel.

41. The display container of claim 32, wherein the curved support surface of the upper front panel and the curved support surface of the lower front panel cooperate to trap the spherical article in place in the C-shaped opening to prevent the spherical article from rotating therein.

* * * * *